US009554684B1

(12) United States Patent
Kauffman

(10) Patent No.: US 9,554,684 B1
(45) Date of Patent: Jan. 31, 2017

(54) FLOOR SCRUBBER WITH SCRUBBER HEAD ADJUSTMENT ASSEMBLY

(71) Applicant: Pacific Steamex Cleaning Systems, Inc., Muskegon, MI (US)

(72) Inventor: Kipling J. Kauffman, Zeeland, MI (US)

(73) Assignee: Pacific Steamex Cleaning Systems, Inc., Muskegon, MI (US)

( * ) Notice: Subject to any disclaimer, the term of this patent is extended or adjusted under 35 U.S.C. 154(b) by 643 days.

(21) Appl. No.: 14/046,201

(22) Filed: Oct. 4, 2013

Related U.S. Application Data

(60) Provisional application No. 61/709,786, filed on Oct. 4, 2012.

(51) Int. Cl.
*A47L 11/40* (2006.01)

(52) U.S. Cl.
CPC ..... *A47L 11/4058* (2013.01)

(58) Field of Classification Search
CPC ..... A47L 11/4058; A47L 11/4091
See application file for complete search history.

(56) References Cited

U.S. PATENT DOCUMENTS 2,978,719 A * 4/1961 Arones ..... A47L 11/16 15/320
2002/0170130 A1* 11/2002 Shinler ..... A47L 11/16 15/49.1
2005/0246845 A1* 11/2005 Duncan ..... A47L 11/16 15/49.1

OTHER PUBLICATIONS

Parts list from Nilfisk-Advance, Inc. for model Adfinity 17ST/20ST.
Parts list from IPC Gansow model IPC Eagle dated Oct. 26, 2006.
Parts and instruction manual from Minuteman International for model E17/E20 floor scrubber.
Parts Manual from R.P.S. Corporation for Micromag model floor scrubber dated 2011.
Parts Manual from Tennant Co. for Nobles brand Speed Scrub model floor scrubber.
Parts Manual from Tennant Co. for T3 floor scrubber.

* cited by examiner

*Primary Examiner* — Randall Chin
(74) *Attorney, Agent, or Firm* — Gardner, Linn, Burkhart & Flory, LLP

(57) ABSTRACT

A floor scrubber comprising a scrubber head and a base assembly, with the base assembly including wheels for movably supporting the floor scrubber on a floor and the scrubber head being movably mounted to the base assembly. The floor scrubber includes a head adjustment assembly operable to place the scrubber head into three orientations including a raised orientation, a standard cleaning orientation, and an increased cleaning pressure orientation in which additional downward force is applied to the scrubber head.

19 Claims, 12 Drawing Sheets

FLOOR SCRUBBER WITH SCRUBBER HEAD ADJUSTMENT ASSEMBLY

CROSS REFERENCE TO RELATED APPLICATION

The present application claims priority of U.S. provisional application, Ser. No. 61/709,786 filed on Oct. 4, 2012, by Kipling J. Kauffman for FLOOR SCRUBBER AND SCRUBBER HEAD, which is hereby incorporated herein by reference in its entirety.

BACKGROUND OF THE INVENTION

The present invention is directed to a floor scrubber with a scrubber head adjustment assembly.

Floor scrubbers are used to clean floor surfaces and include a scrubber head that may be positioned against the floor to provide scrubbing action on the floor. An operator may walk behind the floor scrubber, with the scrubber head being movable between a raised orientation for transporting the floor scrubber when not being used for cleaning, and the noted cleaning orientation in which the scrubber head is positioned against the floor.

Different types of scrubber heads may be mounted to a floor scrubber, including a rotary scrubber head in which the pad is circularly rotated against the floor surface and an orbital scrubber head in which the pad is moved against the floor in an eccentric manner without completely spinning. In the case of orbital scrubber heads, cleaning fluid is conventionally discharged directly onto the floor surface in front of the advancing scrubber head. The cleaning fluid is then worked against the floor surface by the pad of the scrubber head.

SUMMARY OF THE INVENTION

The present invention provides a floor scrubber with a scrubber head adjustment assembly.

According to an aspect of the present invention, a floor scrubber comprises a scrubber head, a head adjustment assembly, and a base assembly. The base assembly includes wheels for movably supporting the floor scrubber on a floor with the scrubber head being movably joined to the base assembly. The adjustment assembly is operable to place the scrubber head into three orientations including a raised orientation, a standard cleaning orientation, and an increased cleaning pressure orientation in which additional downward force is applied to the scrubber head.

In a particular embodiment the adjustment assembly includes a control arm and one or more head arms, with the head arm connecting the scrubber head to the base assembly and the control arm being operable to move the head arm. The control arm may be selectively positioned into three positions associated with the three orientations of the scrubber head. The head adjustment assembly may further include a pivot shaft with the control arm and head arm being connected to the pivot shaft, where pivoting movement of the control arm on the pivot shaft causes the head arm to pivotally move the scrubber head. Still further, the floor scrubber includes a pair of forward wheels and the pivot shaft may be mounted to the base assembly forward of the forward wheels relative to the forward end of the floor scrubber.

The head adjustment assembly may further include a pivot arm connected to the control arm via a linkage, with the control arm imparting force to the pivot arm via the linkage and with the pivot arm being interconnected with the head arm. The linkage may include a biasing member, such as a spring, with the spring imparting a force to the pivot arm when the control arm is in position for placing the scrubber head into the increased cleaning pressure orientation. The pivot arm and one or more head arms may be fixedly connected to the pivot shaft. The linkage may further include a connecting pin that imparts a force to the pivot arm when the control arm is in position for placing the scrubber head into the raised orientation.

The head adjustment assembly in accordance with the present invention provides an increased mechanical advantage for raising the scrubber head and for applying downward force to the scrubber head for increased cleaning pressure. Correspondingly, the control arm of the head adjustment assembly may be readily positioned by an operator into the three operational orientations.

These and other objects, advantages, purposes and features of this invention will become apparent upon review of the following specification in conjunction with the drawings.

DESCRIPTION OF THE PREFERRED EMBODIMENTS

Figure 1:
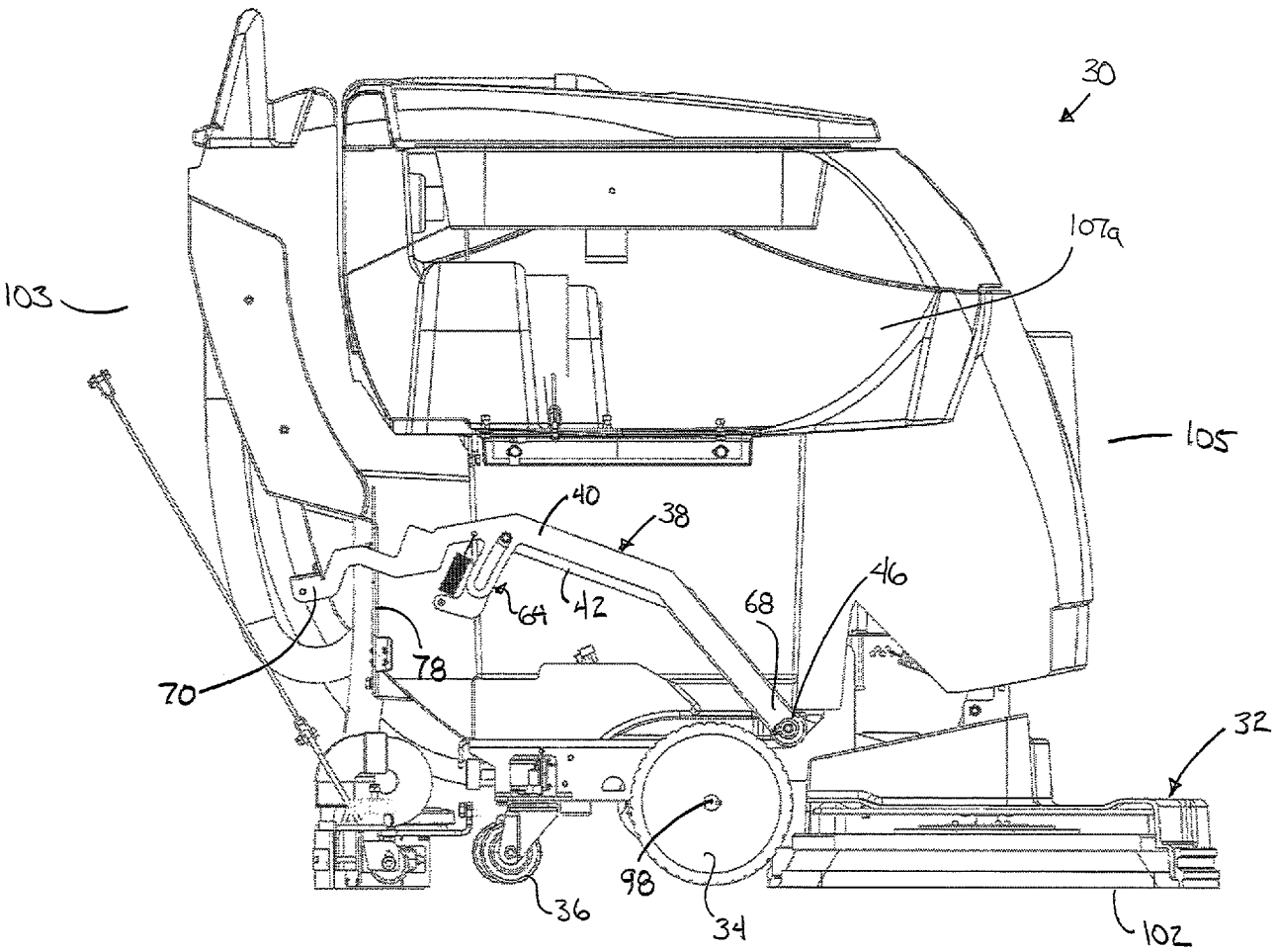
FIG. 1 is a side sectional view of a floor scrubber including a head adjustment assembly in accordance with an aspect of the present invention.

The present invention will now be described with reference to the accompanying figures, wherein the numbered elements in the following written description correspond to like-numbered elements in the figures. A floor scrubber 30 with a head 32 for cleaning floors is shown in FIG. 1, where floor scrubber 30 is an operator walk-behind type scrubber having a base assembly 33 with forward wheels 34 and rear wheels 36 for supporting movement of scrubber 30 on a floor, as well as various tanks for providing cleaning fluid and suctioning and retaining used fluid from the floor. Scrubber 30 further includes a head adjustment assembly 38 for adjusting head 32 into one of three orientations, including a raised position for transport, a normal operating cleaning position, and into an orientation for applying increased downward pressure from head 32 against a floor to provide greater cleaning force.

Figure 2:
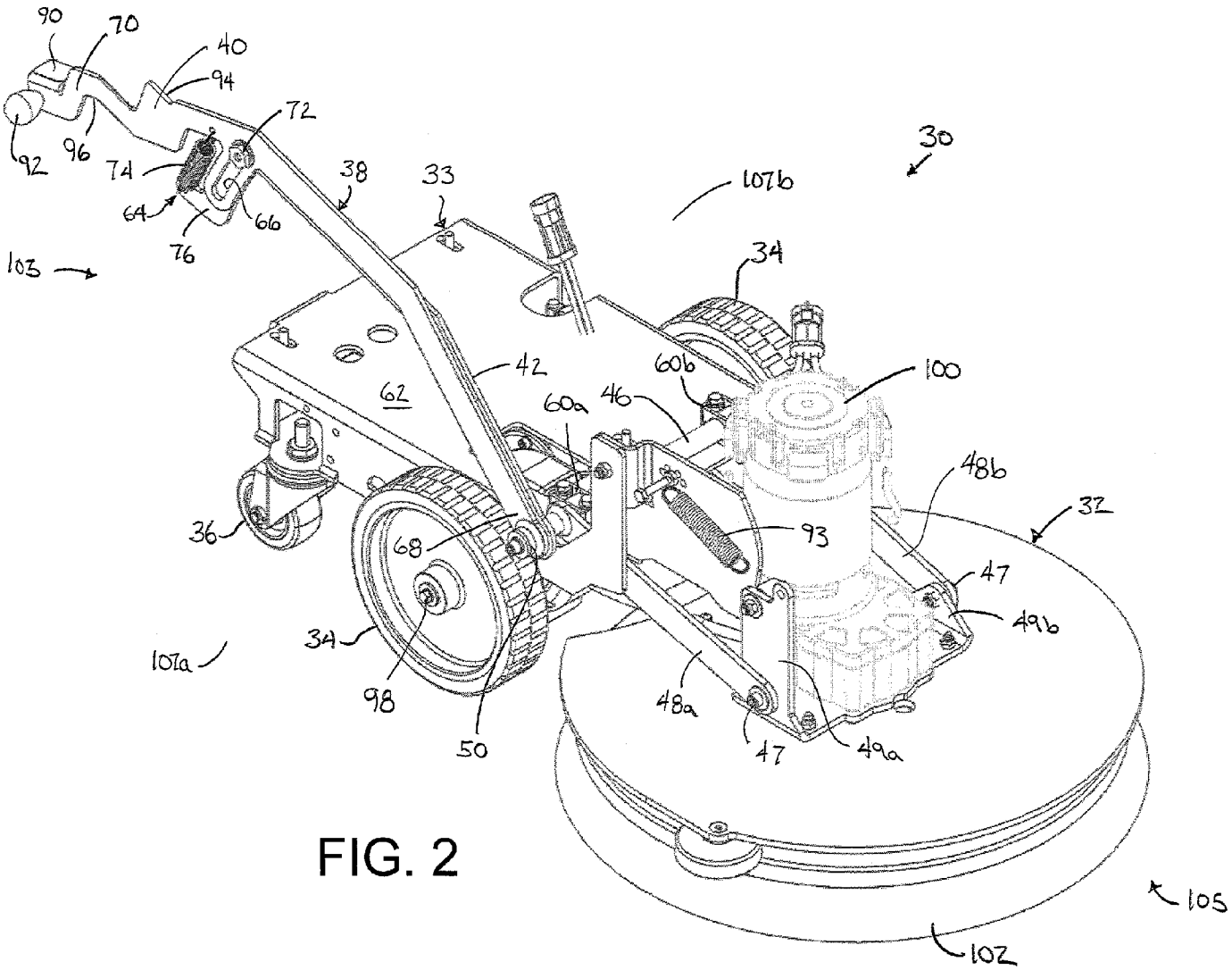
FIG. 2 is a front perspective view of the floor scrubber of FIG. 1 shown with components of the floor scrubber removed for clarity.

As discussed in detail below, in the illustrated embodiment head adjustment assembly 38 includes a pair of adjustment arms comprising a control arm or operator arm 40 and a pivot arm 42, where operator arm 40 extends to a rear portion 44 of scrubber 30. An operator is able to raise and lower operator arm 40 to thereby readily and selectively adjust head 32 into one of the three noted orientations, with operator arm 40 interacting with pivot arm 42 to provide the desired adjustment. With reference to FIG. 2, adjustment assembly 38 additionally includes a pivot member or shaft 46 to which operator arm 40 and pivot arm 42 are connected. Assembly 38 further includes a pair of head arms 48*a*, 48*b* that are connected to pivot shaft 46 at one end and extend and removably connect to head 32 at their opposite ends, such as by connecting to mounting flanges 49*a*, 49*b*, respectively, on head 32 via fasteners 47. In operation, movement of operator arm 40 interacts with pivot arm 42 to impart rotation or torque to pivot shaft 46, with arms 48*a*, 48*b* in turn either lifting head 32 or imparting downward force to head 32 depending on whether operator arm 40 is raised or lowered.

Figure 3:
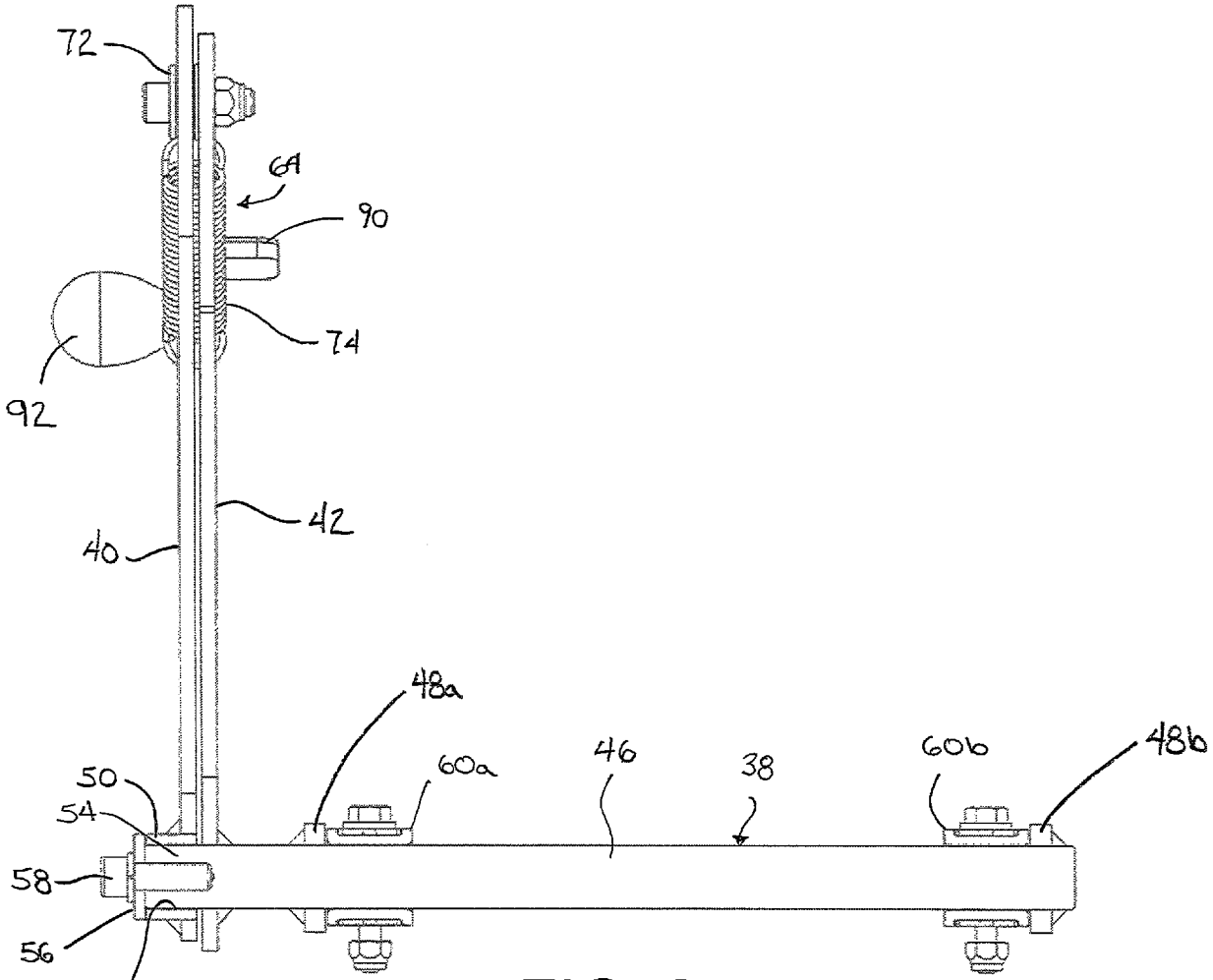
FIG. 3 is a front perspective sectional view of the head adjustment assembly shown separate from the floor scrubber.
Figure 4:
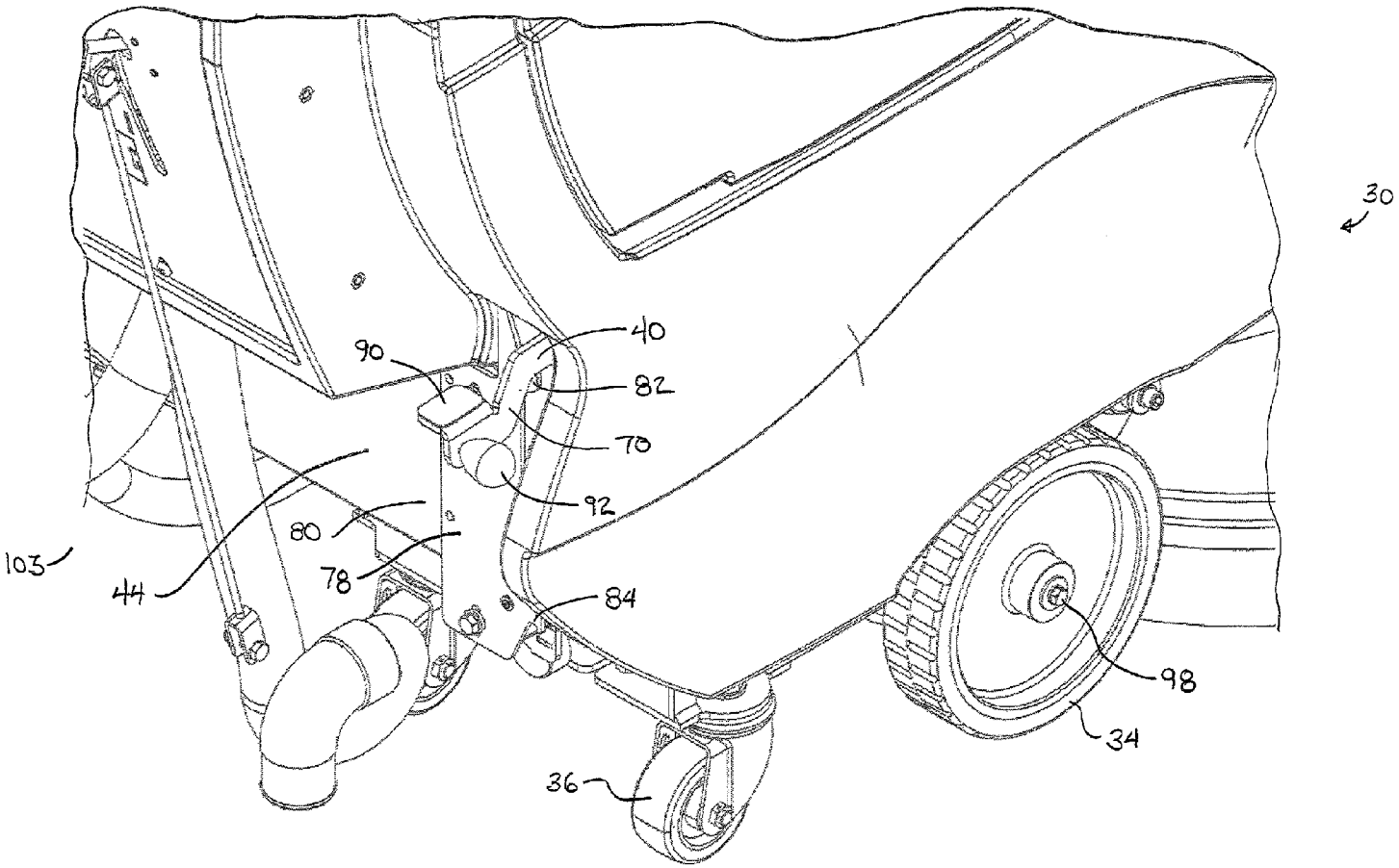
FIG. 4 is a partial rear perspective view of the floor scrubber of FIG. 1 showing the head adjustment assembly engaged with a retention plate.
Figure 5:
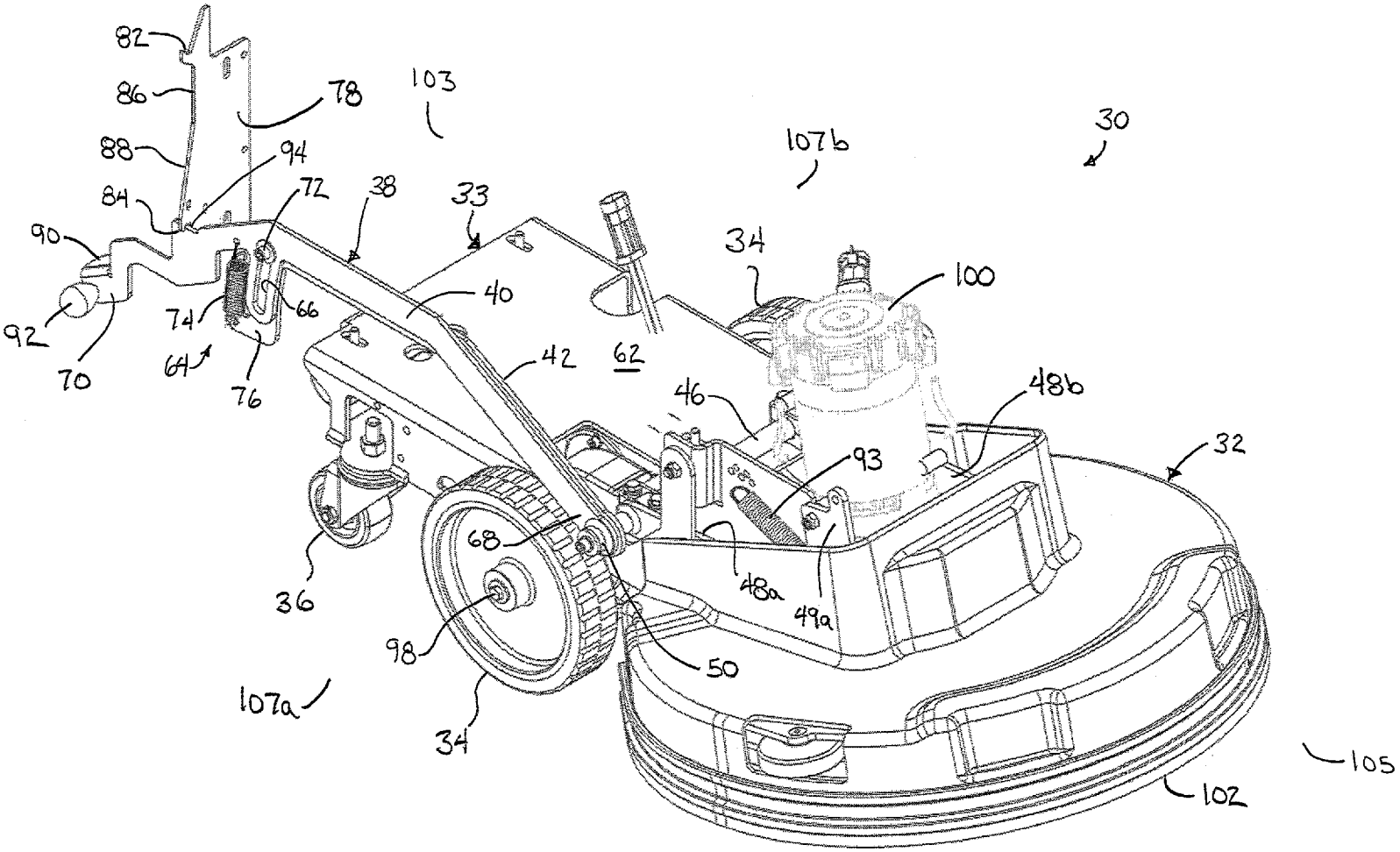
FIG. 5 is a front perspective view of the floor scrubber of FIG. 1 shown with components of the floor scrubber removed for clarity and disclosing the head adjustment assembly engaged with the retention plate in a head raised orientation.
Figure 6:
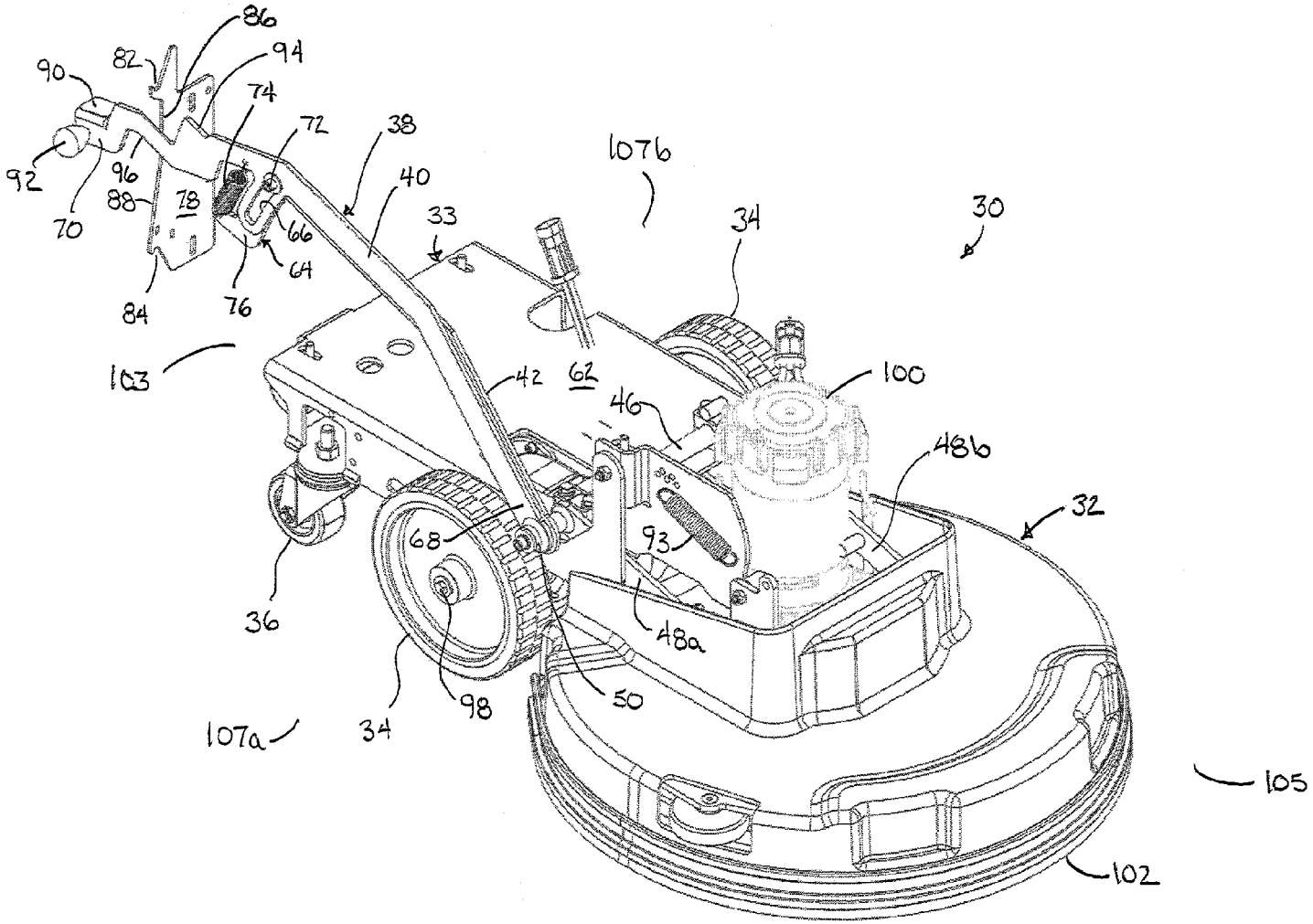
FIG. 6 discloses the floor scrubber of FIG. 5 with the head adjustment assembly in a normal cleaning orientation.
Figure 7:
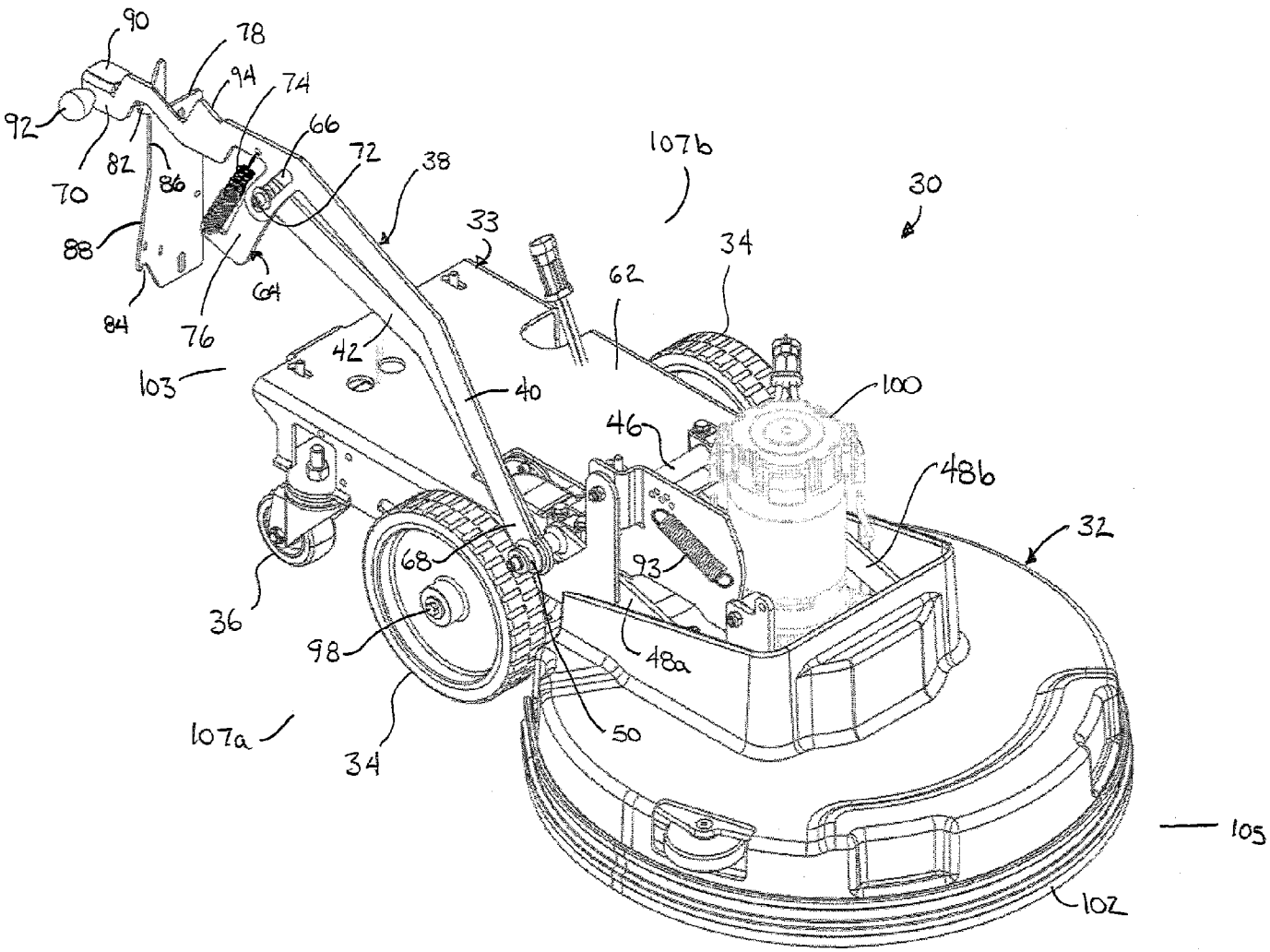
FIG. 7 discloses the floor scrubber of FIG. 5 with the head adjustment assembly engaged with the retention plate in an orientation providing increased head cleaning pressure.

Pivot arm 42 and head arms 48*a*, 48*b* are fixedly secured to pivot shaft 46 such that pivot arm 42, pivot shaft 46 and head arms 48*a*, 48*b* move together. As understood from FIG. 3, in the illustrated embodiment pivot arm 42 and head arms 48*a*, 48*b* are affixed to pivot shaft 46 by welding to form a unitary weldment assembly. Operator arm 40 includes a boss member 50, where boss member 50 is shown welded to operator arm 40 in the illustrated embodiment and positioned over pivot shaft 46. Boss member 50 includes a shaft hole 52 sized to enable operator arm 40 to rotate relative to shaft 46 such that operator arm 40 is able to rotate on shaft 46. As also understood from FIG. 3, pivot arm 42 is affixed to shaft 46 inwardly from the end 54 of shaft 46 to provide a mounting area for operator arm 40 via boss member 50, with operator arm 40 being retained on shaft 46 by washer 56 and bolt 58 affixed to end 54 of shaft 46. Pivot shaft 46 is in turn rotatable within bearing assemblies 60*a*, 60*b* that are mounted to a frame member 62 (FIG. 2) of scrubber 30, where each bearing assembly 60*a*, 60*b* comprises a plastic bearing block surrounding shaft 46 to aid in the rotational pivoting motion of shaft 46.

Figure 9:
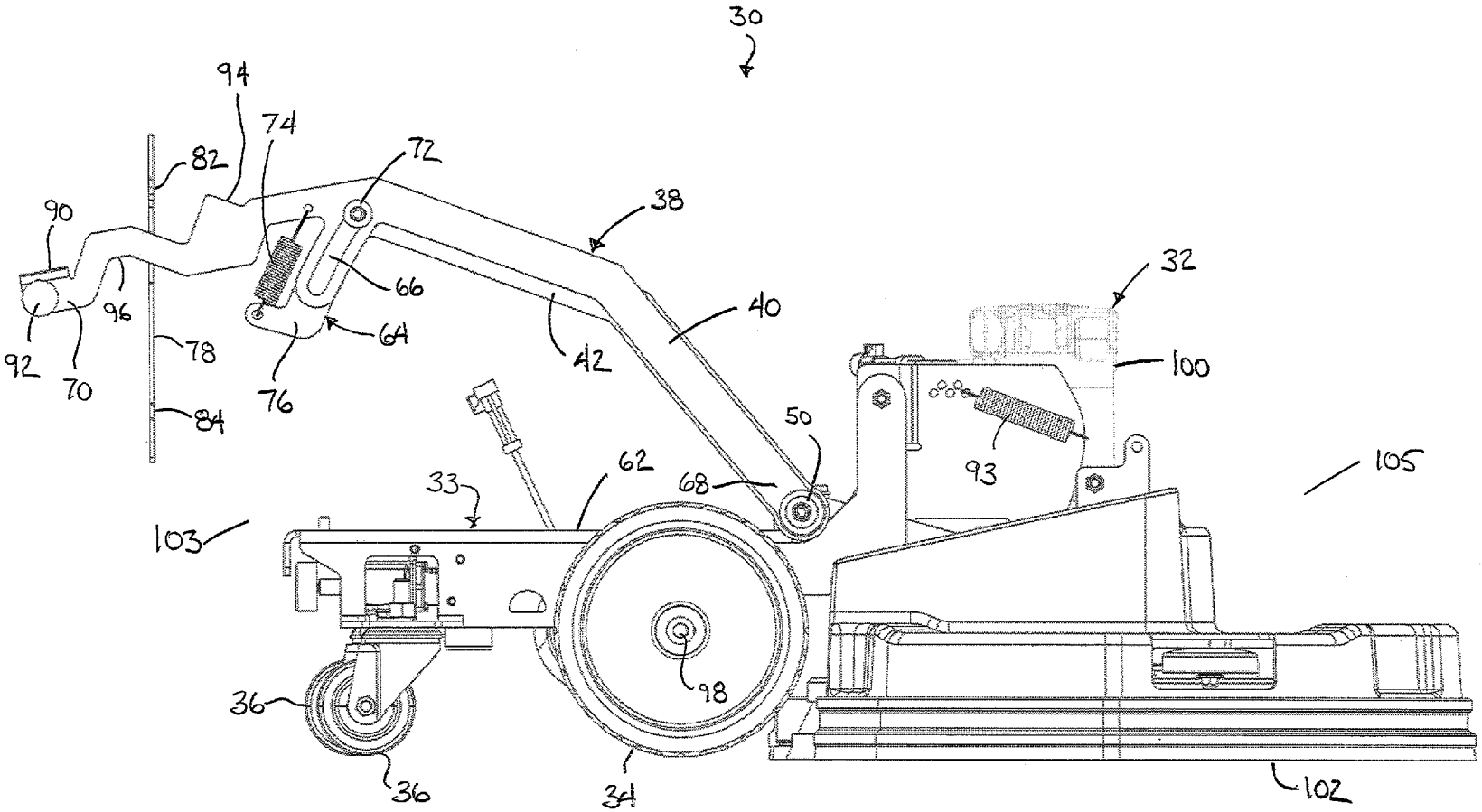
FIG. 9 is a side elevation view of the floor scrubber arrangement of FIG. 6.

Operator arm 40 interacts with pivot arm 42 via linkage 64 whereby movement of operator arm 40 is able to impart movement or force on pivot arm 42. Operator arm 40 includes a slot 66 located between the distal ends of operator arm 40, where one end 68 of operator arm 40 is connected to pivot shaft 46 as discussed above and the other end of operator arm 40 comprises the operator end 70 that is engaged by an operator. Pivot arm 42 is connected to operator arm 40 by way of linkage 64 comprising a pin 72 and biasing member, which in the embodiment shown comprises a coil spring 74 connected within a hole of operator arm 40 at one end and a hole of pivot arm 42 at an opposite end. Pin 72 projects from pivot arm 42 and is slidably engaged within slot 66 whereby, as discussed below, movement of operator arm 40 imparts movement or force to pivot arm 42 when pin 72 engages with either of the closed ends of slot 66. Pivot arm 42 includes an elbow 76 with spring 74 being connected to pivot arm 42 at elbow 76 and connected to operator arm 40 such that spring 74 is able to provide a biasing force between operator arm 40 and pivot arm 42, which force will tend to bias or rotate operator arm 40 downward in the normal cleaning orientation such that pin 72 is seated or contacts with the upper end of slot 66 (see FIG. 9).

Scrubber 30 further includes a retention bracket or plate 78 mounted at rear portion 44, such as to solution tank 80 of scrubber 30 in the embodiment shown, where bracket 78 is used to retain operator arm 40 when operator arm 40 is selectively positioned by an operator into the above noted orientations. Bracket 78 includes a first lock member comprising an upper retainer or retention notch 82 and a second lock member comprising a lower retainer or retention notch 84, where notch 82 is formed as an upwardly extending L-shaped projection from bracket 78 and notch 84 is formed as a downwardly extending L-shaped projection from bracket. Notch 82 and notch 84 are separated by an edge 86 that includes an angled guide portion 88.

As shown in the various views, end 70 of operator arm 40 includes a tab 90 and a handle 92 for engagement by an operator for placing operator arm 40 into one of the three noted orientations. To raise head 32 up into the transport orientation of FIG. 8, an operator may push down on tab 90 with his or her foot, such as for example, from the normal cleaning orientation of FIG. 9 in which spring 74 biases operator arm 40 such that pin 72 is in the upper closed end of slot 66. Accordingly, downward movement of operator arm 40 imparts corresponding downward pivoting movement to pivot arm 42 via the connection of operator arm 40 to pivot arm 42 by pin 72. Continued downward pivoting movement of pivot arm 42 causes shaft 46 to rotate, which in turn causes head arms 48*a*, 48*b* to pivot upward, thereby raising or angularly pivoting head 32 upwards. As shown in FIG. 2, a biasing member, such as spring 93, may be connected to flanges 49*a*, 49*b* to reduce side torque caused by the rotating pad 102 of scrubber head 32 by increasing the pressure on the rearward portion of the pad 102. When being pushed down by an operator, operator arm 40 rides along angled guide portion 88 of edge 86 on bracket 78 until an upper edge 94 of operator arm is received within notch 84. Guide portion 88 provides a lateral displacement to operator arm 40 such that operator arm 40 will tend to be biased into engagement with notch 84 upon being rotated below notch 84. With head 32 so raised, scrubber 30 may be moved or transported without head 32 engaging the surface of a floor.

Figure 8:
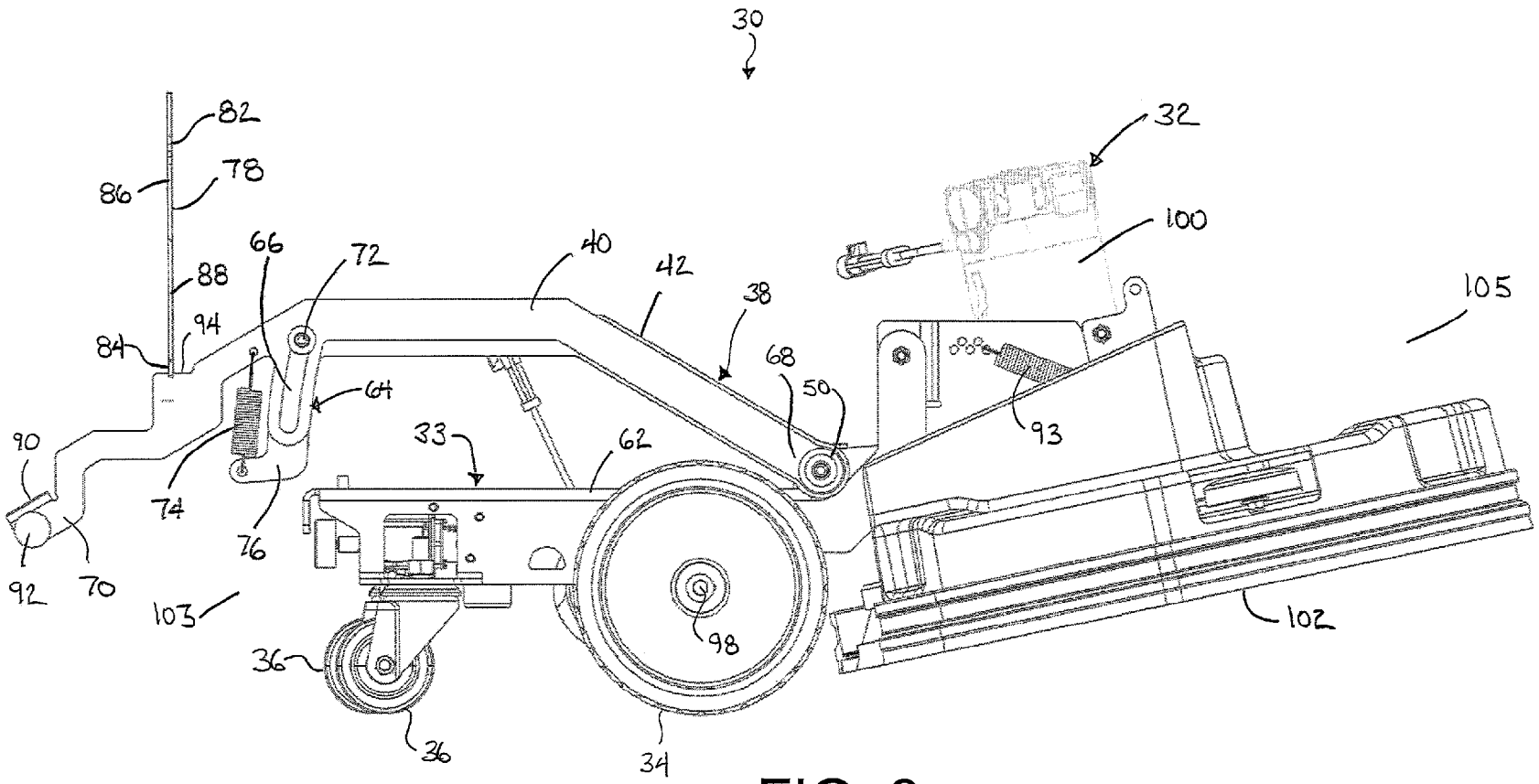
FIG. 8 is a side elevation view of the floor scrubber arrangement of FIG. 5.

To return head 32 into position for cleaning a floor from the raised head position of FIG. 8, an operator may release operator arm 40 from notch 84 and lower head 32 by using their foot on tab 90. For example, by initially providing a slight downward and outward movement to operator arm 40, arm 40 may be removed from notch 84. The operator may then lower head 32 by allowing operator arm 40 to rotate upward by the torque imparted to shaft 46 from the gravitational force on head 32. Operator arm 40 and pivot arm 42 will move in concert as a result of pin 72 engaging with the upper closed end of slot 66. In the standard cleaning orientation of FIG. 9, operator arm 40 is positioned between notches 82, 84. In this orientation the cleaning force or pressure imparted to a floor is substantially based on the weight of head 32. Because arms 48*a*, 48*b* are able to pivot on shaft 46, head 32 substantially rests on the floor under its own weight.

Figure 10:
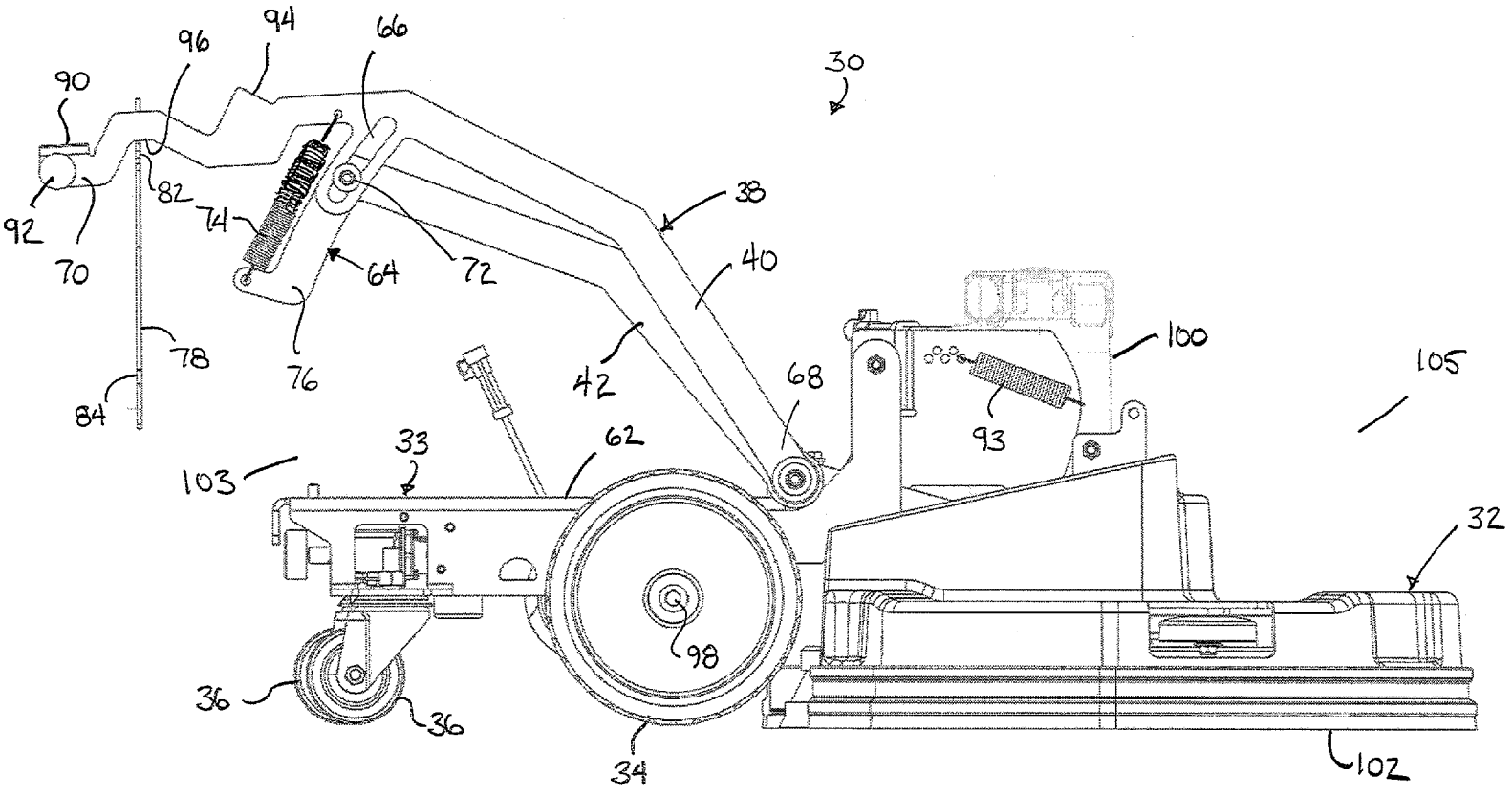
FIG. 10 is a side elevation view of the floor scrubber arrangement of FIG. 7.
Figure 11:
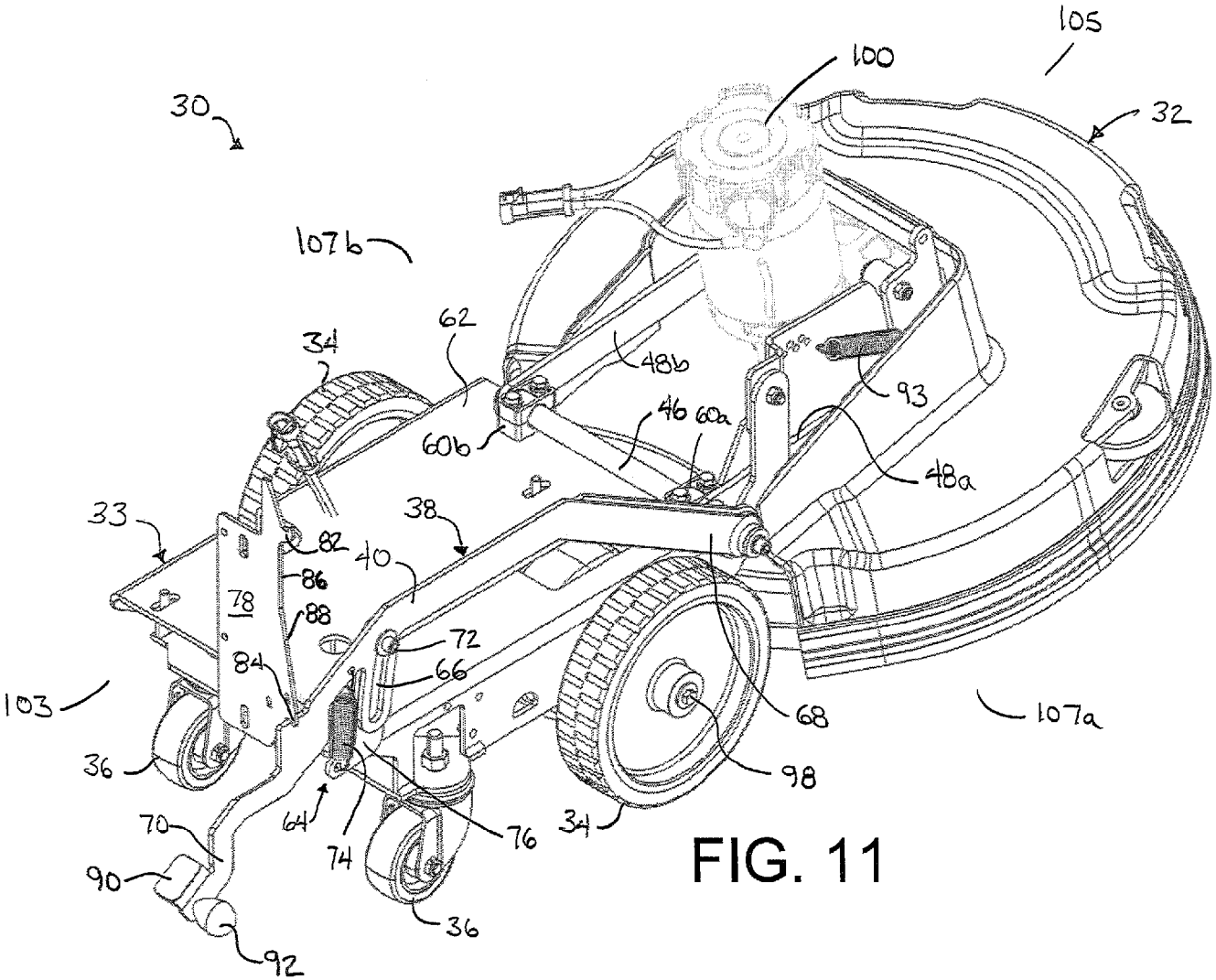
FIG. 11 is a rear perspective view of the floor scrubber arrangement of FIG. 5.

As previously noted, however, scrubber 30 enables increased downward pressure to be imparted by head 32 to a floor for increased cleaning force, which is obtained by positioning head adjustment assembly 38 into the orientation shown in FIG. 10. To place assembly 38 into this orientation from the normal cleaning orientation of FIG. 9, an operator grasps handle 92 and lifts upward on operator arm 40. Upward movement of operator arm 40 causes arm 40 to rotate on shaft 46 independently of rotation of shaft 46 via boss member 50. Operator arm 40 also moves independently of pivot arm 42 with pin 72 sliding within slot 66, with this upward movement of operator arm 40 stretching spring 74 while pivot arm 42 remains substantially stationary. That is, with head 32 positioned into contact with a floor, pivot arm 42 is substantially prevented from rotating upward due to pivot arm 42 being fixedly connected with shaft 46. Upon raising operator arm 40, an operator may place the lower edge 96 of operator arm 40 into notch 82 to thereby secure adjustment assembly 38 into the increased pressure position. When so positioned, spring 74 operates to provide an upward biasing force on pivot arm 42 about shaft 46, which biasing force correspondingly operates to provide an increased downward force by head 32 on the floor that is to be cleaned. Head 32 may be subsequently removed from this position via use of handle 92 to remove operator arm 40 from notch 82.

As shown in the various views, operator arm 40 is longer than head arms 48*a*, 48*b* such that a mechanical advantage is obtained when an operator applies upward or downward force on end 70 to either increase cleaning pressure or raise head 32, respectively. In the illustrated embodiment, pivot arm 42 is also longer than head arms 48*a*, 48*b* and pivot shaft 46 is positioned forward of the axis 98 of wheels 34. This mechanical advantage is increased by mounting shaft 46 to frame member 62 forward of axis 98 and extending operator arm 40 outwardly to the rear portion 44 of scrubber 30. In the illustrated embodiment, the distance from shaft 46 to end 70 of operator arm 40 defines a first radial distance relative to shaft 46, the distance from shaft 46 to linkage 64 connecting operator arm 40 and pivot arm 42 defines a second radial distance relative to shaft 46, and the distance from shaft 46 to the point of connection with head 32 along arms 48*a*, 48*b* defines a third radial distance relative to shaft 46. As described above with respect to the illustrated embodiment, the first and second radial distances are greater than the third radial distance, with the first radial distance being approximately 25 inches, the second radial distance being approximately 18 inches, and the third radial distance being approximately 10 inches. Accordingly, significant downward force on head 32 may be obtained when moving head 32 into the orientation of FIG. 10 with a lighter, less expensive spring 74 and light lifting force by an operator on operator arm 40. In the illustrated embodiment, for example, for every one pound of lifting force applied by the operator, 2.5 lbs of additional downward force are placed on head 32, with 1.8 lbs of downward force being placed on head 32 for every one pound of force generated by the extension of spring 74. Thus, to increase the downward force on the head by 30 lbs, 16.7 lbs must be generated at spring 74 and only 12 lbs of lifting force from an operator at end 70 of operator arm 40. It should be appreciated that a mechanical advantage may still be obtained with alternative lengths of operator arms, pivot arms, and head arms.

Moreover, head arms 48*a*, 48*b* are connected at flanges 49*a*, 49*b* to be generally equally spaced about a central axis of head 32, such as on either side of motor 100 in the illustrated embodiment. Accordingly, when operator arm 40 is in the raised position such that arms 48*a*, 48*b* apply increased downward force on head 32, the force is generally equally distributed to head 32, with spring 93 also providing a downward force to head 32 to reduce rotational side torque as discussed above.

Figure 12:
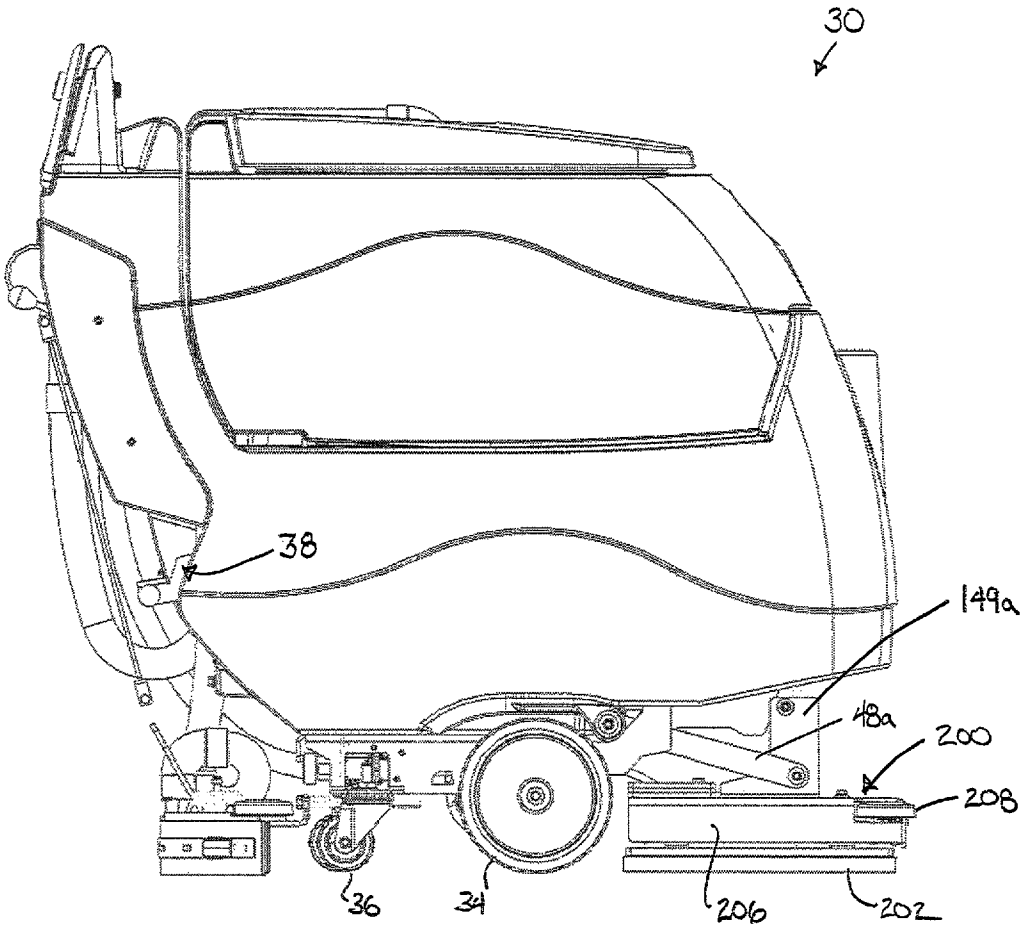
FIG. 12 is a side elevation view of the floor scrubber of FIG. 1 with an alternative scrubber head.

In the embodiment shown floor scrubber 30 includes a rearward end 103, a forward end 105, and lateral sides 107*a*, 107*b*, with scrubber head 32 being mounted at forward end 105. It should be appreciated that alternative arrangements, geometries, lengths and configurations of adjustment assembly 38, including with regard to operator arm 40, pivot arm 42, linkage 64, and head arms 48*a*, 48*b*, as well as with regard to the location and arrangement of pivot shaft 46 relative to base assembly 33, may be employed within the scope of the present invention. Still further, although shown with a rotary scrubber head 32, alternative types, styles and designs of scrubber heads may be employed with floor scrubber 30 including, for example, orbital scrubber heads, such as the orbital scrubber head 200 (FIG. 12) as disclosed in U.S. provisional patent application Ser. No. 61/709,786 to which the present application claims priority. In general, head 200 includes a pad 202, a cover 206, guide wheels 208 (one shown), and mounting flanges 149*a* (one shown) to which the head arms 48*a*, 48*b* are connected.

Changes and modifications in the specifically described embodiments can be carried out without departing from the principles of the present invention which is intended to be limited only by the scope of the appended claims, as interpreted according to the principles of patent law including the doctrine of equivalents.

The invention claimed is:

1. A floor scrubber, said floor scrubber comprising:

a scrubber head;

a base assembly, said base assembly including wheels for movably supporting said floor scrubber on a floor with said scrubber head being movably joined to said base assembly; and a head adjustment assembly, said adjustment assembly operable to place said scrubber head into multiple orientations including a raised orientation, a standard cleaning orientation, and an increased cleaning pressure orientation in which additional downward force is applied to said scrubber head;

wherein said adjustment assembly includes a control arm, a pivot arm, and a head arm that are configured to extend from and pivot about a common pivot axis, with said head arm joining said scrubber head with said base assembly and said pivot arm being interconnected with said head arm whereby movement of said pivot arm imparts movement to said head arm, and with said pivot arm being connected to said control arm via a linkage with said control arm imparting force to said pivot arm via said linkage and said control arm being operable to move said head arm via said pivot arm, and with said control arm able to be selectively positioned into separate positions associated with said multiple orientations of said scrubber head, and wherein said floor scrubber has a rearward end at which an operator engages said floor scrubber, a forward end opposite said rearward end, and lateral sides between said forward end and said rearward end with said pivot axis extending between said lateral sides.

2. The floor scrubber of claim 1, wherein said wheels comprise a pair of forward wheels at said forward end and a pair of rearward wheels at said rearward end, and wherein said pivot axis is disposed forward of the axis of rotation of said forward wheels relative to said forward end of said floor scrubber.

3. The floor scrubber of claim 1, wherein said pivot axis is defined by a pivot shaft, and wherein said pivot shaft is mounted to said base assembly, and wherein said control arm, said pivot arm, and said head arm are joined to said pivot shaft.

4. The floor scrubber of claim 1, wherein said linkage comprises a slot within which a pin travels.

5. The floor scrubber of claim 4, wherein said control arm includes said slot and said pivot arm includes said pin, and wherein movement of said control arm imparts movement to said pivot arm via said pin.

6. The floor scrubber of claim 1, wherein said linkage includes a biasing member connected to said control arm and said pivot arm, said biasing member imparting a force to said pivot arm when said control arm is in said position for placing said scrubber head into said increased cleaning pressure orientation, with said pivot arm in turn imparting a force to said head arm.

7. The floor scrubber of claim 6, wherein said biasing member comprises a spring.

8. The floor scrubber of claim 1, wherein said linkage includes a connecting pin, said connecting pin imparting a force to said pivot arm when said control arm is in said position for placing said scrubber head into said raised orientation.

9. The floor scrubber of claim 1, wherein said control arm is mounted for rotation on said pivot shaft and said pivot arm is shorter than said control arm and extends generally axially therewith.

10. The floor scrubber of claim 1, wherein said head arm comprises a pair of head arms, and wherein said head arms are connected to said scrubber head generally equally spaced about a central vertical axis of said scrubber head.

11. The floor scrubber of claim 1, further including a retention plate, wherein said control arm engages with said retention plate to place said scrubber head into said raised orientation and said increased cleaning pressure orientation.

12. The floor scrubber of claim 11, wherein said retention plate is mounted at said rearward end.

13. The floor scrubber of claim 12, further including a pair of lock members configured to selectively receive and retain said control arm, with one of said lock members receiving said control arm to place said scrubber head into said raised orientation and the other said lock member receiving said control arm to place said scrubber head into said increased cleaning pressure orientation.

14. A floor scrubber, said floor scrubber comprising:

a scrubber head;

a base assembly, said base assembly including wheels for movably supporting said floor scrubber on a floor with said scrubber head being movably joined to said base assembly; and a head adjustment assembly, said adjustment assembly including a control arm, a pivot arm, a pivot shaft and a head arm;

said control arm, said pivot arm and said head arm being connected to and extending from said pivot shaft whereby said pivot shaft defines an axis of rotation for said control arm, said pivot arm and said head arm about said pivot shaft, and said control arm being connected to said pivot arm via a linkage with said control arm imparting force to said pivot arm via said linkage, and with said head arm being connected to said scrubber head with said control arm being operable to move said head arm via said pivot arm whereby said control arm is operable to place said scrubber head into multiple orientations including a raised orientation, a standard cleaning orientation, and an increased cleaning pressure orientation in which additional downward force is applied to said scrubber head.

15. The floor scrubber of claim 14, wherein said control arm comprises an elongate member and includes an operator end for engagement by an operator, and wherein said linkage is connected to said control arm inwardly from said operator end.

16. The floor scrubber of claim 15, wherein said control arm is connected to said pivot shaft at an end opposite said operator end, and wherein said head arm comprises an elongate member having an end connected to said pivot shaft and an opposite end connected to said scrubber head, and wherein a radial distance defined from said pivot shaft to the connection of said linkage on said control arm is greater than a radial distance defined from said pivot shaft to the connection of said scrubber head with said head arm.

17. The floor scrubber of claim 14, wherein said linkage comprises a connecting pin, said connecting pin imparting a force to said pivot arm when said control arm is used to raise said scrubber head.

18. A floor scrubber, said floor scrubber comprising:

a scrubber head;

a base assembly, said base assembly including wheels for movably supporting said floor scrubber on a floor with said scrubber head being movable relative to said base assembly; and a head adjustment assembly, said adjustment assembly including a control arm, a pivot arm and a head arm that are joined to and extend from a pivot shaft whereby said pivot shaft defines a common axis of rotation for said control arm, said pivot arm and said head arm;

said pivot shaft pivoting about an axis that is generally parallel with the axis of rotation of said wheels with said head arm being mounted to said pivot shaft and said scrubber head being mounted to said head arm distally from said pivot shaft, with movement of said pivot arm being operable to pivot said pivot shaft in order to adjust the position of said scrubber head;

wherein said pivot arm is connected to said control arm via a linkage with said control arm imparting force to said pivot arm via said linkage, and wherein said control arm extends beyond said linkage toward a rearward end of said floor scrubber.

19. The floor scrubber of claim 18, wherein said linkage includes a connecting pin, said connecting pin imparting a force to said pivot arm when said control arm is oriented to raise said scrubber head, and wherein said linkage includes a biasing member, said biasing member imparting a force to said pivot arm when said control arm is oriented to place said scrubber head into an increased cleaning pressure orientation.

* * * * *